United States Patent [19]

Dorosz

[11] 4,448,139

[45] May 15, 1984

[54] AUTOMATIC THREAD CHANGING SEWING MACHINE

[75] Inventor: Adolph S. Dorosz, Beverly, Mass.

[73] Assignee: USM Corporation, Farmington, Conn.

[21] Appl. No.: 315,415

[22] Filed: Oct. 27, 1981

[51] Int. Cl.[3] ..... F23G 5/04

[52] U.S. Cl. ..... 112/221; 112/254; 112/253; 112/274; 112/276; 112/262.1

[58] Field of Search ..... 112/221, 163–167, 112/254, 255, 241, 253, 287, 286, 288, 279, 274, 262.1

[56] References Cited

U.S. PATENT DOCUMENTS

| | | | |
|---|---|---|---|
| 1,880,164 | 9/1932 | Whitehouse | 112/274 |
| 3,160,125 | 12/1964 | Bryant et al. | 112/79 R |
| 3,266,449 | 8/1966 | Berg et al. | 112/221 |
| 3,502,044 | 3/1970 | Brown et al. | 112/79 R |
| 3,641,955 | 2/1972 | Brown et al. | 112/79 R |
| 3,724,405 | 4/1973 | Mullen | 112/221 |
| 3,738,298 | 6/1973 | Albrecht | 112/254 |
| 3,763,805 | 10/1973 | Weigert | 112/167 |
| 4,075,958 | 2/1978 | Sacchetti | 112/221 |
| 4,186,672 | 2/1980 | Burton | 112/273 |
| 4,196,685 | 4/1980 | Tamura | 112/273 |
| 4,276,838 | 7/1981 | Bolldorf | 112/221 |
| 4,301,756 | 11/1981 | Teetz et al. | 112/221 |
| 4,328,758 | 5/1982 | Souza et al. | 112/286 |

*Primary Examiner*—Ronald Feldbaum

*Attorney, Agent, or Firm*—Donald N. Halgren

[57] ABSTRACT

A sewing machine having two needles supported in a needle holder, which needle holder is horizontally displacable, to present one needle to an active workstation in a prethreaded manner and simultaneously shift the other needle which has a different thread therein, into an adjacent inactive position. As the needles are being shifted, the needle moving to inactive status has its thread clamped against the needle holder by a wheel, to secure the thread from being pulled therefrom or straying. A vacuum tube arranged at each respective inactive position or station sucks the tail of the thread therein. A pair of thread guides, one for each thread, are arranged for vertical movement, to pullback on the dangling thread of the inactive needle, to prevent the thread from whipping during its inactive status. Each thread passes around a thread engaging wheel comprising a dual bobbin monitor arranged on a single axis. A thrust bearing is arranged between each thread engaging wheel and an adjustable knob is arranged to bias the sides of the wheels to allow each thread to have the same tension regardless of its current status, active or inactive. A wedge arrangement at the drive end of the sewing machine mates into a groove on a disk attached to the drive shaft which wedge arrangement, after stopping the drive shaft from rotating, then permits the shifting of the needles from active to inactive status. The wedge mating in the groove of the shaft insures proper alignment of the shifting mechanism permitting the shuttling of the needles from their inactive to the active position and vice versa.

17 Claims, 9 Drawing Figures

AUTOMATIC THREAD CHANGING SEWING MACHINE

BACKGROUND OF THE INVENTION

1. Field of the Invention

This invention relates to sewing machines, and more particularly to sewing machines having multiple threads and needles.

2. Prior Art

Multiple threads and multiple needles on sewing machines are useful mechanisms for improving product output. The mechanisms are typically used for tufting or embroidering and may be seen as embodiments in U.S. Pat. Nos.: 3,724,405 to Mullen, Jr.; 3,547,058 to Brown et al; and 3,160,125 to Bryant et al. They each show multiple needle arrangements with transfer mechanisms therefor. The '405 patent discloses an embroidery machine permitting threads of different colors to be stitched into a material, using a complicated solenoid arrangement for empowerment thereof. The '058 patent also discloses a solenoid driving arrangement, which therein utilizes a scanner to traverse a pattern being reproduced. The '125 patent discloses a tufting machine with a bank of needles controlled by a long thrust bar and thrust rods. These machines are often inflexible as to providing a variety of stitch work, because they utilize long arrays of linkages and drives that cannot be readily adapted to doing tight tensioned work through heavy pieces of material, that is, sewing which is mostly functional or non-decorative.

Thus, it is an object of the present invention to provide a sewing machine capable of overcoming the disadvantages of the prior art.

It is a further object of the present invention to provide a sewing machine capable of utilizing several needles with their own respective threads, the threads being varied in color, size or texture from one another.

It is yet a further object of the present invention, to provide a sewing machine that can vary the threads and needles automatically, while monitoring thread usage.

BRIEF SUMMARY OF THE INVENTION

The present invention comprises a sewing machine for placing tensioned stitches of differing threads into heavy material such as leather or the like. The machine comprises a pair of needles, each movable longitudinally when situated in a working or active position, and each being movable transversely to an inactive position to permit the other needle to assume the active, working position. Each needle is threaded and held in a support or needle holder. Each needle holder is arranged in a needle holder indexer which permits longitudinal movement of the needle holders therein. The holders are disposed in a needle holder indexer or carriage which shuttles the holders from the active to one or the other of the inactive positions. The needle holder indexer is linked to an indexing cylinder which, when properly actuated, effectuates the transverse shuttling movement of the needles in their supports in a needle holder cage. A biased ball is arranged in the needle holder cage to mate with a detent in the needle holders, to accurately position the needle holders and needles therewith, subsequent to the transverse shuttle. A pair of fixed axis wheels or biasing devices such as clips or the like may be disposed beneath the needle holder cage, one wheel each, between the active, middle work station, and the respective inactive stations on both sides of the active station. Transverse movement of either needle and its needle holder from the active position to its respective inactive position is sufficient to clinch the thread of the needle between its respective wheel and the lower portion of the needle holder to prevent the thread from being inadvertently pulled out of the needle.

Adjacent each inactive station is a suction tube, directed towards the eye of the needle. The suction tubes draw in air and the tail of the thread of the inactive needle, so that the tail of the thread of the inactive needle will not be sewn into the stitching of the active needle.

Thread pullback means are arranged to keep the thread going to the inactive needle from whipping around. The pullback means comprises a pair of actuatable cylinders with a guide loop at each lower end, which cylinders may be pneumatically operated, one guide loop for each thread, to pull upwardly and hold the inactive thread out of the way while the other guide loop for the active needle and thread is extended to its lowermost position. When one needle is shifted from the active position to its respective inactive position, and the other needle is shifted from its respective inactive position to the active position, the respective actuatable cylinders and guide loops change their position from a lower position to an upper position for the needle going to inactive status, and the guide loop for the needle going to active status moves from its upper location to its lower location. The actuatable cylinders have a rod extending from their upper ends, which rod strikes an adjustable stop, which is part of its support bracket, thus permitting regulation of the stroke thereby.

Thread use of the needles in the active position is monitored by a dual bobbin monitor having a photoelectric pick-up device arranged with a pair of disks, each disk having a perforated periphery, each disk being associated with a thread engaging wheel, both wheels and disks being mounted on a common axis to save space on the sewing machine and facilitate simultaneous adjustment thereof. The wheels are separated by a thrust bearing. A single adjustable tension control knob is arranged on the distal end of the axis to effectuate changes in the rotational characteristics of the wheels, and accordingly, the tension in the respective threads. If the size and texture of the threads are the same, and only their color differs, a friction surface on the perforated disk or another friction disk adjacent the wheels can have similar frictional surfaces. If the threads differ in texture or size, the surface characteristics of the friction disks adjacent the wheels may be changed or replaced with respect to the contiguous non-rotative surfaces of the axis or frame of the machine to properly regulate tension in the two threads.

The needles can not be shifted from active to inactive positions and vice versa, without both the needle holders being properly aligned in the needle holder indexer. Accordingly, the angular position of the drive shaft which reciprocably moves a connecting rod attached to a needle drive bar, must be accurately controlled, inasmuch as the connecting rod effectuates the longitudinal reciprocal movement of the needle holder and needle when it is in the active position. A pulley hand-wheel on the driven end of the drive shaft has a wedge shaped detent arranged therein, which detent receives a pneumatically actuated wedge to ensure the proper angular position of the drive shaft to within ±½ one degree, thus permitting proper alignment of the needle holders of the needles with the needle holder indexer, prior to shuttle motion of the needle holder indexer in the needle holder cage.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
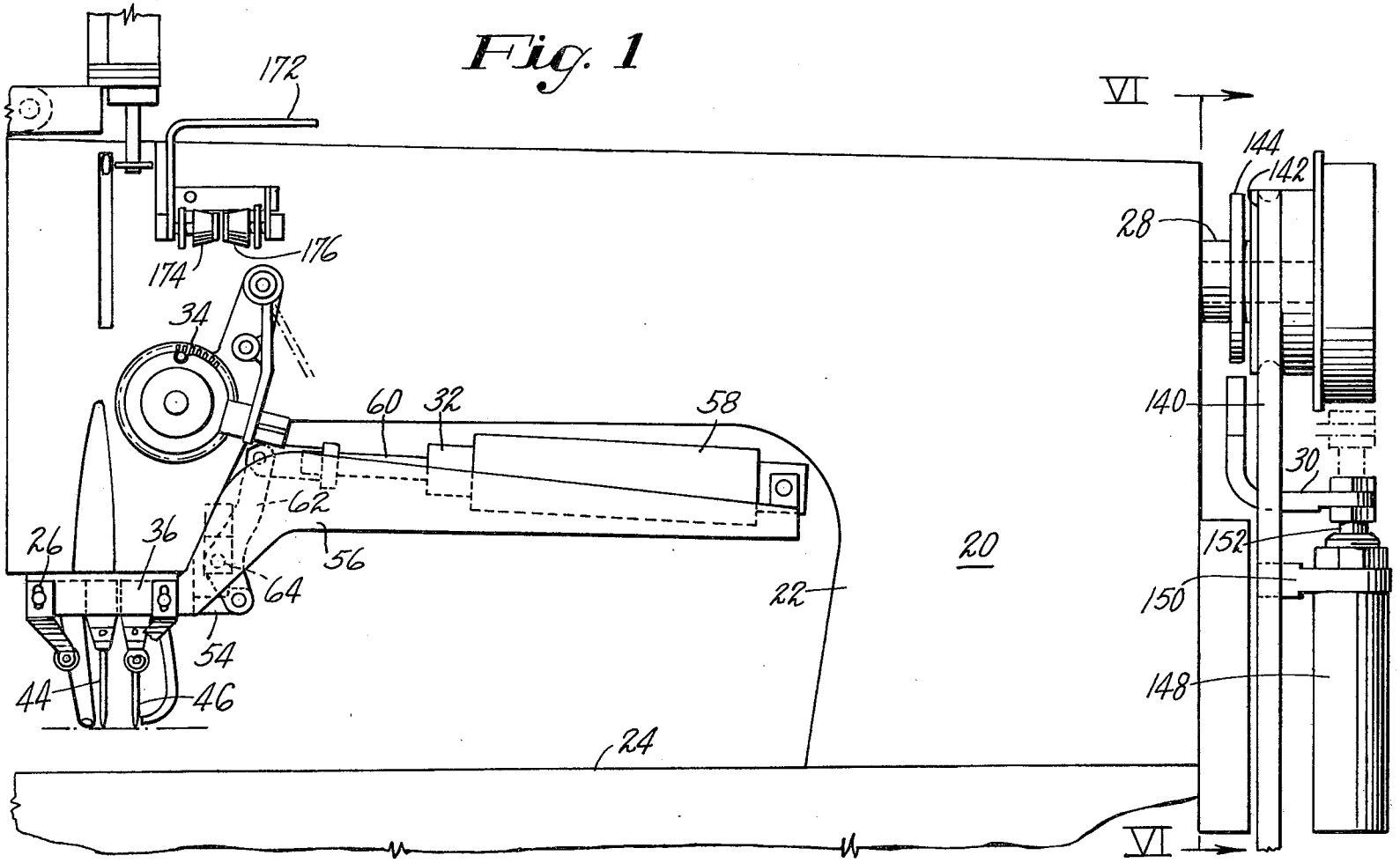
FIG. 1 is a side elevational view of a sewing machine constructed according to the principles of the present invention.

Referring now to the drawings in detail and particularly to FIG. 1, there is shown an automatic thread changing sewing machine 20 capable of sewing two different threads into an item to be stitched. The threads may be of a different color, texture, or size, depending upon the requirements of the item being sewn. The sewing machine 20 comprises a housing 22 disposed on a work support table 24. A stitching mechanism 26 is disposed at one end of the housing 22 and is connectively associated therethrough by a drive shaft 28 to a drive means 30 at the other end of the housing 22. An indexing mechanism 32 is connected to the stitching mechanism 26 to effectuate shuttling therein. A bobbin monitor 34 controls the thread feed and usage and checks for irregularities associated therewith.

Figure 2:
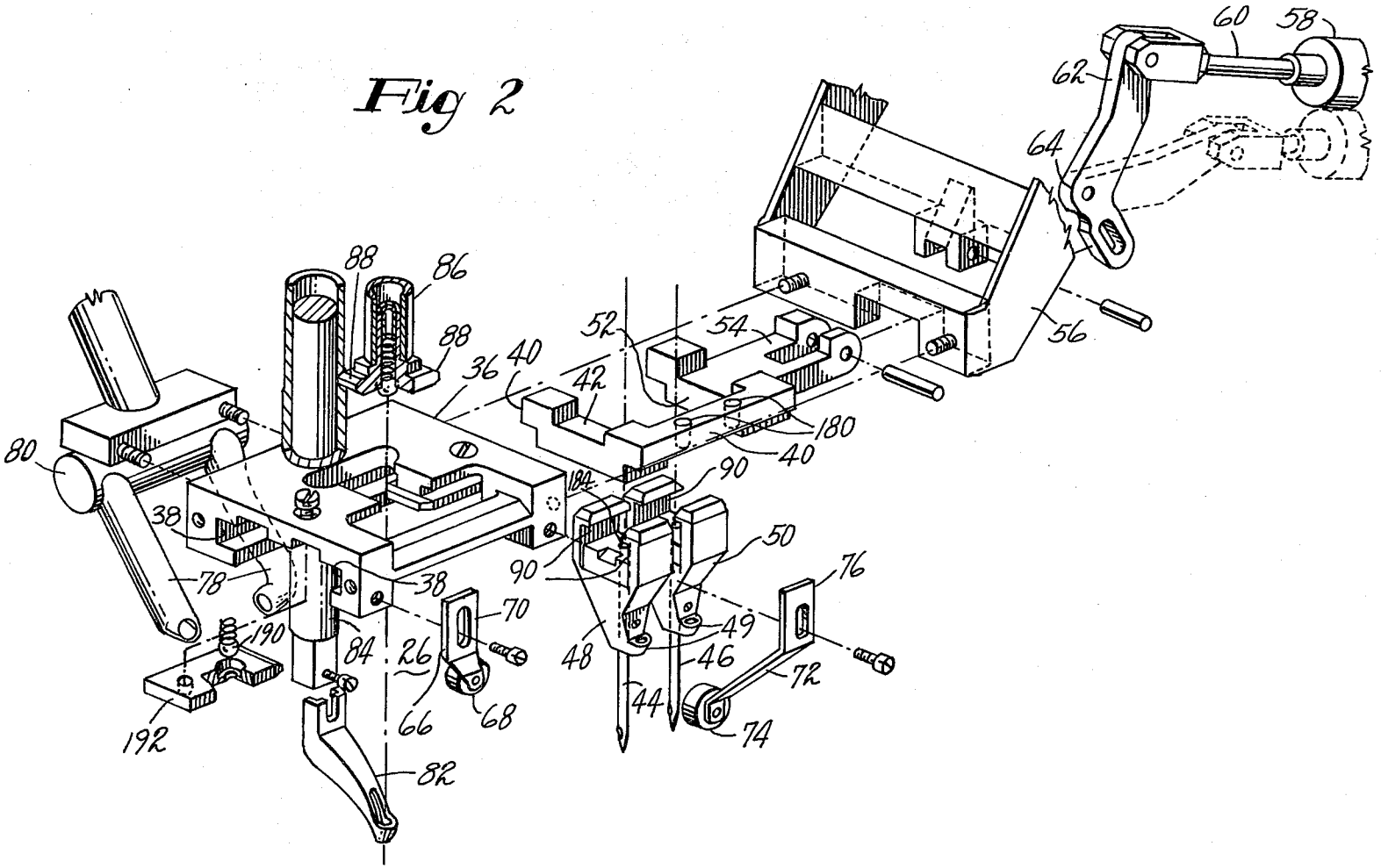
FIG. 2 is an exploded view of a part of the needle support and indexing mechanism.

The stitching mechanism 26 is shown more clearly in FIG. 2, which mechanism comprises a needle holding cage 36 which mounts against the lower side of the housing 22, and which cage 36 has a pair of opposed channels 38 which each slidingly receive a shoulder 40 of a needle holder indexer 42. A first needle 44, and a second needle 46 are each secured in a needle holder, 48 and 50, respectively, and are slidably received in an opening 52 within the needle holder indexer 42. The holder indexer 42 has an extension 54 which slides under a bracket 56 one end of which bracket 56 is secured to the needle holding cage 36. The other end of the bracket 56 pivotally supports an indexing cylinder 58, which comprises a part of the indexing mechanism 32. The indexing cylinder 58 has a piston, not shown, and a piston rod 60 which is pivotally connected to one end of an indexing lever 62. The other end of the indexing lever 62 is swingably connected to the extension 54 of the needle holder indexer 42. An elbow 64 disposed near the midpoint of the indexing lever 62 is pivotally attached to the bracket 56.

A first thread nipper 66 comprising a biasing element or resilient wheel 68 on a first bracket 70 is secured to the needle holder cage 36, and a second thread nipper 72 comprising a biasing element or resilient wheel 74 on a second bracket 76, is also secured to the needle holder cage 36. The first thread nipper 66 is disposed close to the position of the first needle 44 in its inactive position, and the second thread nipper 72 is disposed close to the position of the second needle 46 in its inactive position.

A pair of vacuum tubes 78 have their distal ends disposed near the inactive position of each needle 44 and 46, respectively, as shown in FIGS. 1 and 2. The tubes 78 may be connected to a manifold 80 which may be secured to the needle holder cage 36, and which manifold 80 is connected to a vacuum source, not shown.

A presser foot 82, is disposed adjacent the active position for the first and second needles 44 and 46, and is reciprocably held by a presser foot bar 84 which extends through a fitting in the needle holder cage 36.

Figure 3:
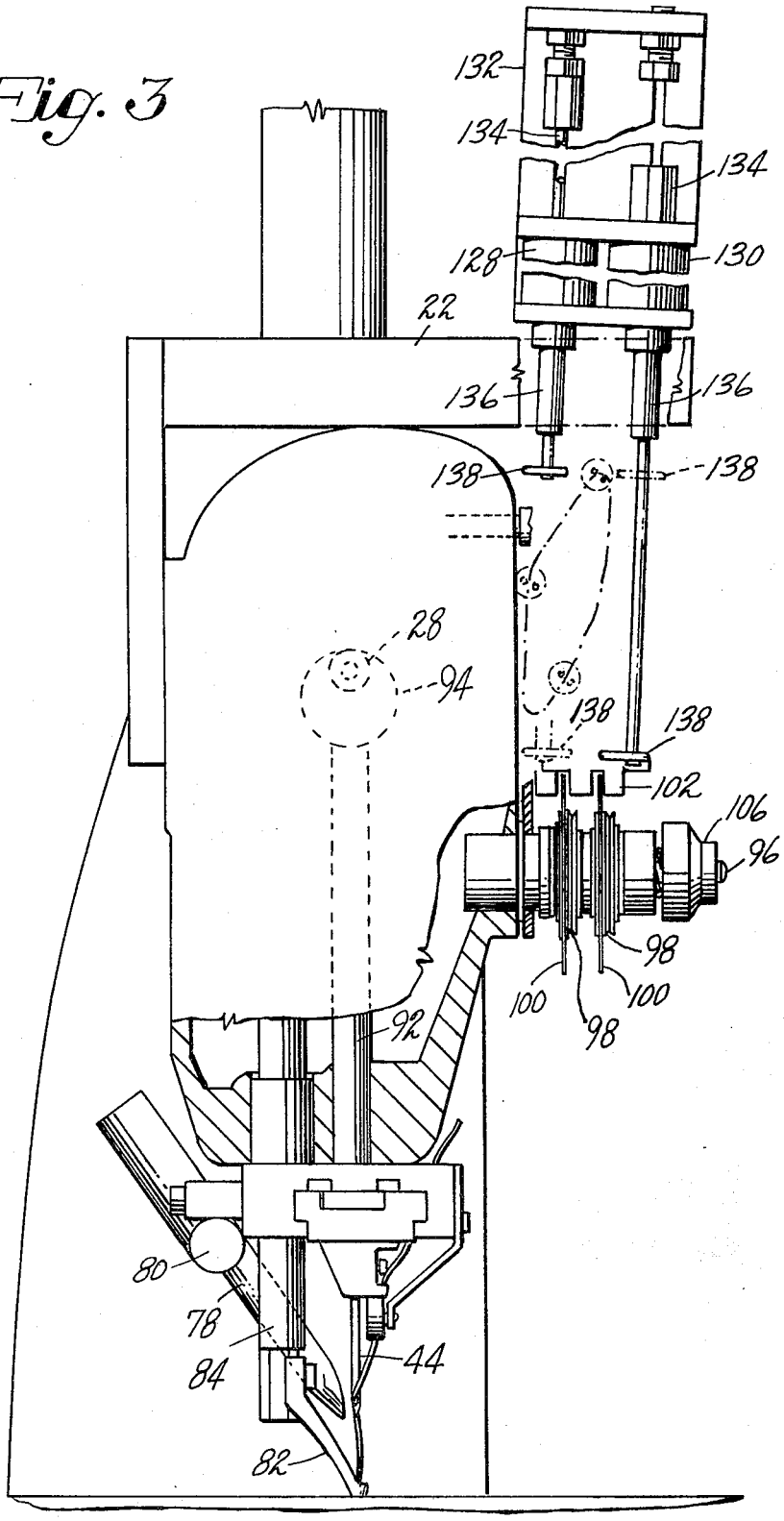
FIG. 3 is an elevational view of one end of the sewing machine.

A needle bar 86, shown in FIG. 2, has an arrangement of flanges 88 on the lower end thereof, which flange 88 slidingly mate successively with a pair of opposed channels 90 on the upper end of each needle holder 48 and 50. The needle bar 86 extends through an opening above the active position of the needles 44 and 46, the upper end of the needle bar 86 being pivotally connected to the lower end of a connecting rod 92, as shown in FIG. 3. The connecting rod 92 is journalled on a crank shaft 94, on the end of the drive shaft 28, shown also in FIGS. 1 and 6.

Figure 4:
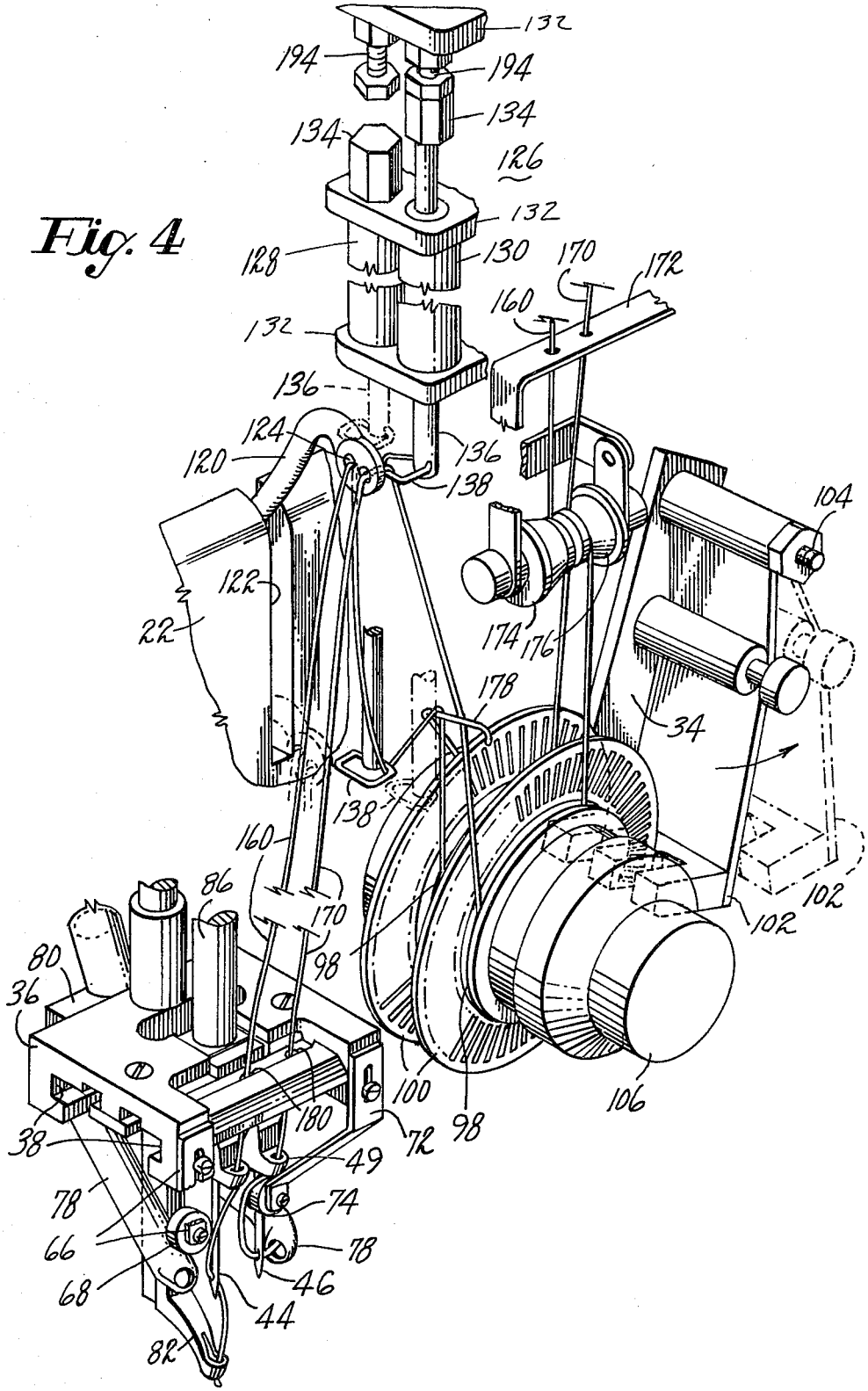
FIG. 4 is a partial perspective view of the thread path and bobbin monitor arrangement of the present invention in one operational mode.
Figure 5:
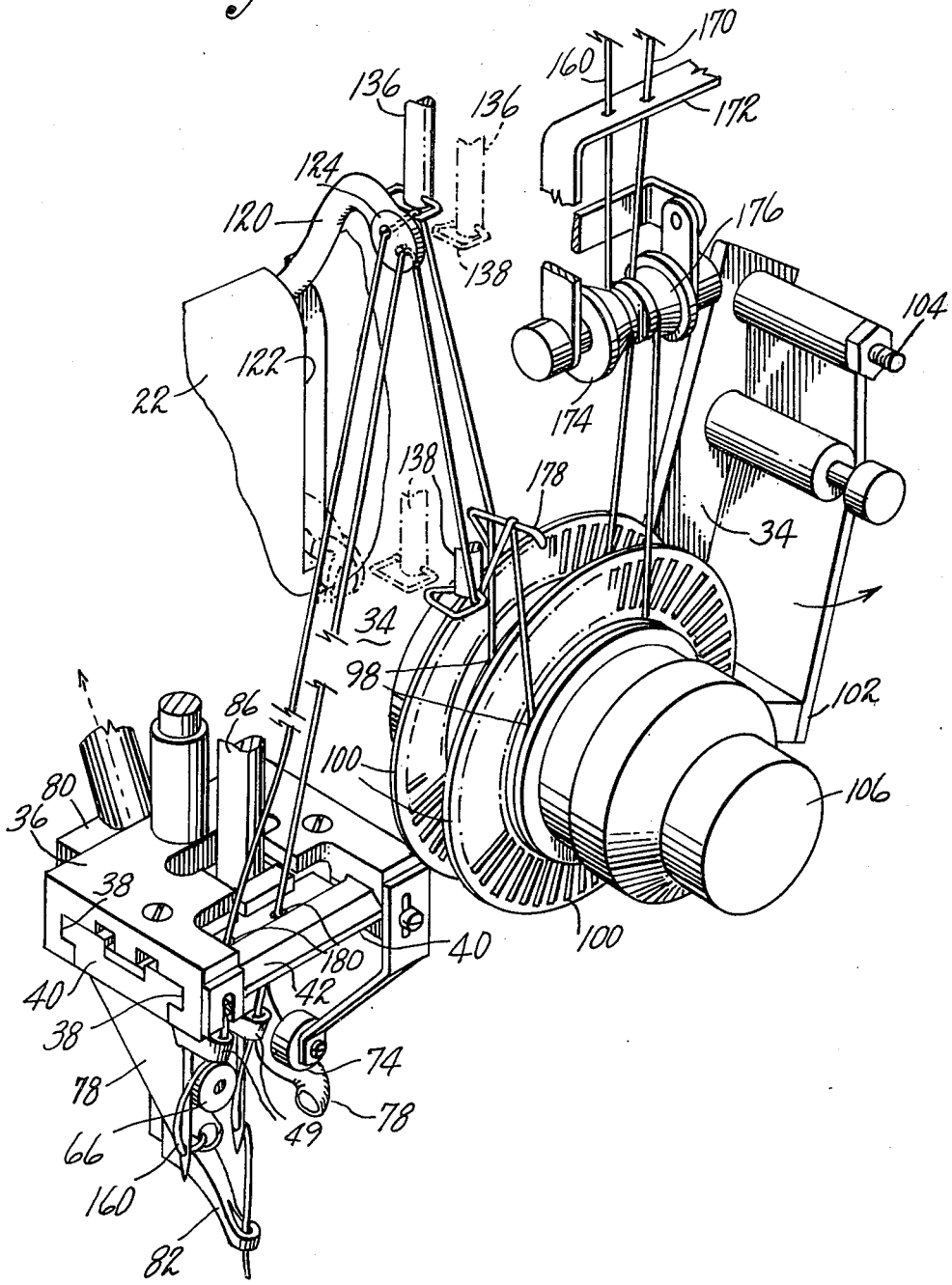
FIG. 5 is a view similar to FIG. 4, with the sewing machine in a subsequent operational mode.
Figure 7:
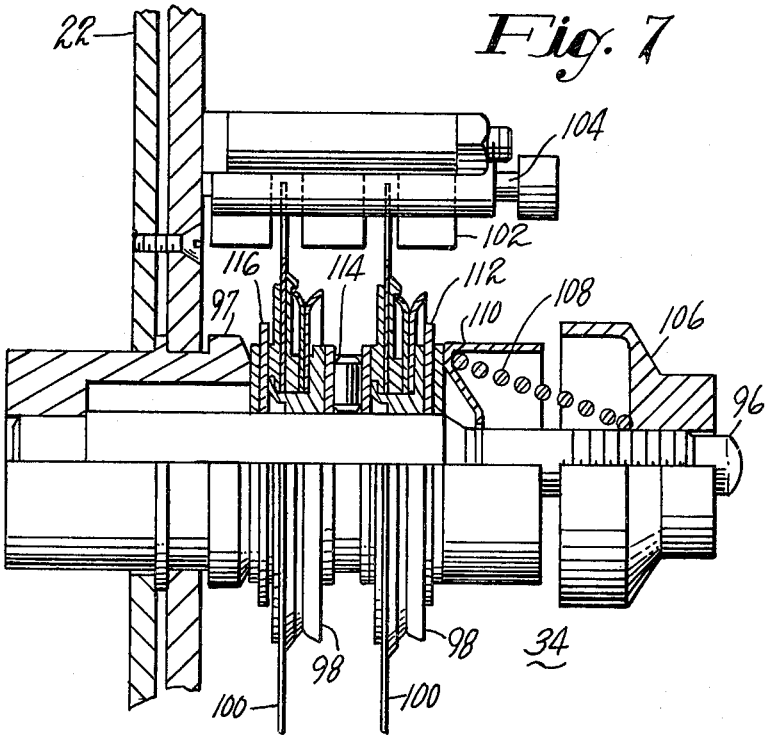
FIG. 7 is a partial sectional view of the bobbin monitor arrangement.

The bobbin monitor 34, shown in FIGS. 4, 5 and 7 comprises an axis 96 journalled into a ferrule 97 supported in the housing 22, the axis 96 having a pair of thread engaging wheels 98 rotatively disposed thereon. A disk 100, having perforations arranged on its periphery, is secured to a side of each wheel 98, in a manner similar to the arrangement shown in U.S. Pat. No. 3,843,883, which is now incorporated herein, by reference. The peripheral perforations are counted by a photoelectric device 102 adapted with an encoder, not shown, to monitor the thread usage. The photoelectric device 102 is pivotally mounted on a shaft 104 secured to the housing 22, and may be swung out of the way to permit thread to be wound around the thread engaging wheels 98, which pivoting out of the way is shown in dashed lines in FIGS. 4 and 5. An adjustment knob 106 is threadably received on the distal end of the shaft 96, which knob 106 may be rotated to compress a spring 108 or biasing member between the knob 106 and an annular non-rotative housing 110 disposed on the axis 46 and against a friction disk 112 adjacent the outer thread engaging wheel 98. A roller thrust bearing 114 is disposed between the contiguous sides of the inner and outer thread engaging wheels 98, and a second friction disk 116 is disposed against the inner side of the inner thread engaging wheel 98 and into a butting contact with a non-rotative portion of the ferrule 97 as shown in FIG. 7.

A take-up lever 120, shown in FIGS. 4 and 5, extends from a slot 122 in the housing 22, and has distal portion 124 with two orifii through which the two threads pass. The take-up lever 120 is shown in both its upper and its lower position in both FIGS. 4 and 5. A thread pullback device 126, is shown in FIGS. 1, 3 and 4. The pullback device 126 comprises a first and a second pressurizable cylinder 128 and 130, attached to a bracket 132 secured to the housing 22. Each pressurizable cylinder 128 and 130 actuatable by proper means, not shown, is a double acting pressurizable cylinder each having an upper piston rod 134 and a lower piston rod 136 extending from their upper and lower ends, respectively. A guide ring 138 is arranged on the distal end of each lower piston and rod 136.

Figure 6:
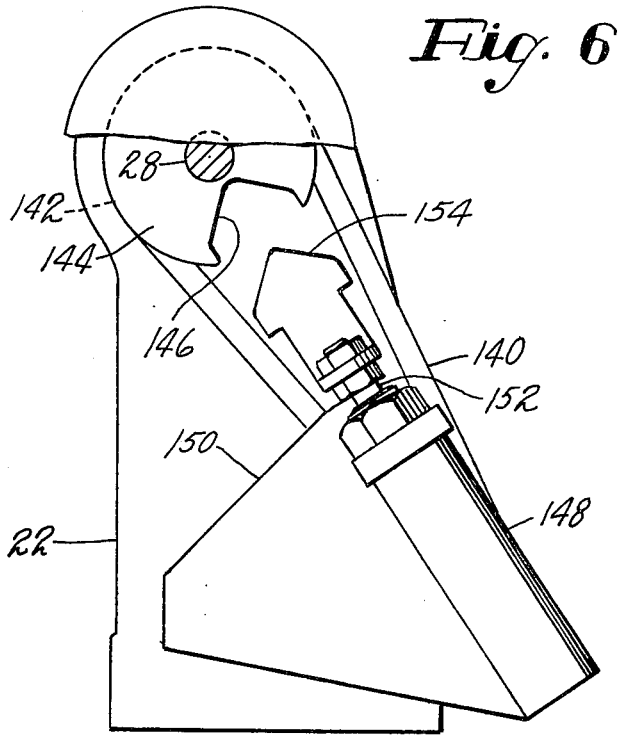
FIG. 6 is a view taken along the lines VI—VI of FIG. 1.

The drive shaft 28, shown in FIGS. 1 and 6, is turned by the drive means 30, which may include a motor, not shown, and may be attached to a drive belt 140, which travels about a pulley 142 on the drive shaft 28. A disk 144 is disposed on the drive shaft 28 adjacent the pulley 142. The disk 144 has a wedge shaped detent 146 arranged therein, as shown in FIG. 6. A pressurizable cylinder 148 is attached to the frame 22 of the sewing machine 20, by a bracket 150 secured generally under the drive shaft 28. The cylinder 148 has a movable piston rod 152 extending therefrom. A wedge shaped extension 154 is attached to the distal end of the movable piston rod 152, matable with the wedge shaped detent 146 in the disk 144 on the drive shaft 28.

In operation of the sewing machine 20, a pair of thread filaments 160 and 170, shown in FIGS. 4 and 5 are unwound from their respective spools, not shown, and extend through openings in a guide bracket 172 attached to the frame 22 above the bobbin monitor 34. The threads 160 and 170 each pass through a thread retainer 174 and 176 beneath the guide bracket 172, and are each wound around a thread engaging wheel 98 while the photoelectric device 102 is pivoted out of the way therefrom, as shown by the phantom lines in FIGS. 4 and 5. The threads 160 and 170 are then drawn around a guide spring 178 and through the guide rings or loops 138 on the distal end of each lower piston rods 136 on the thread pullback device 126, thence through their respective orifice on the distal portion 124 of each takeup lever 120 each thence through a channel 180 in the front shoulder 40 of the needle holder indexer 42, shown in FIGS. 2, 4 and 5. The threads then extend through an opening on a tab 49 on the lower portion of the needle holders 48 and 50, then through the eyes of their respective needles 44 and 46.

Figure 8:
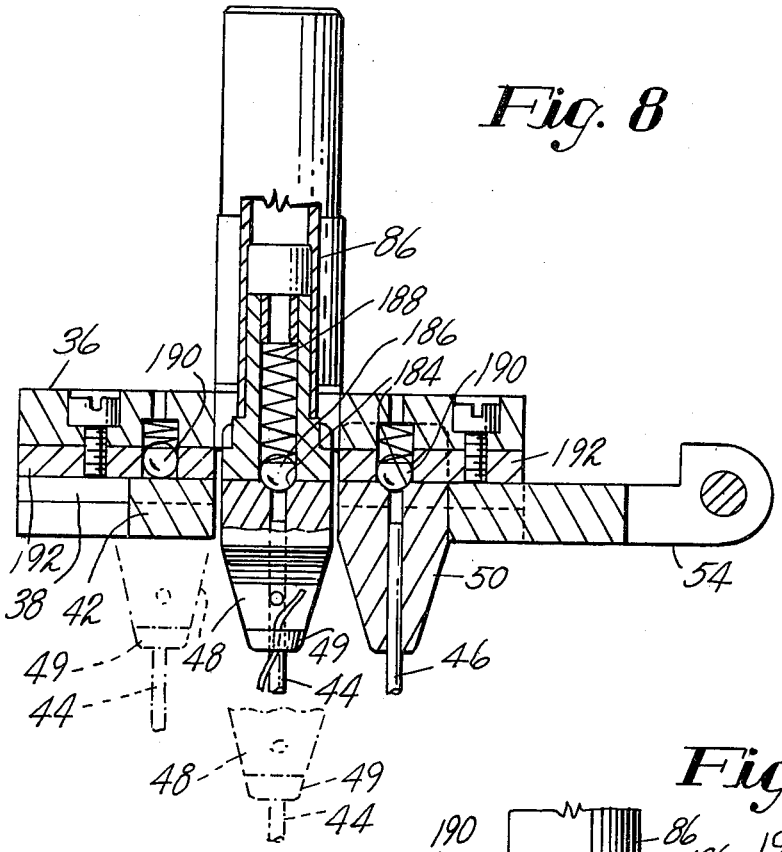
FIG. 8 is a partial sectional view of the sewing machine needle holders and needle holder indexer in a first operational mode.
Figure 9:
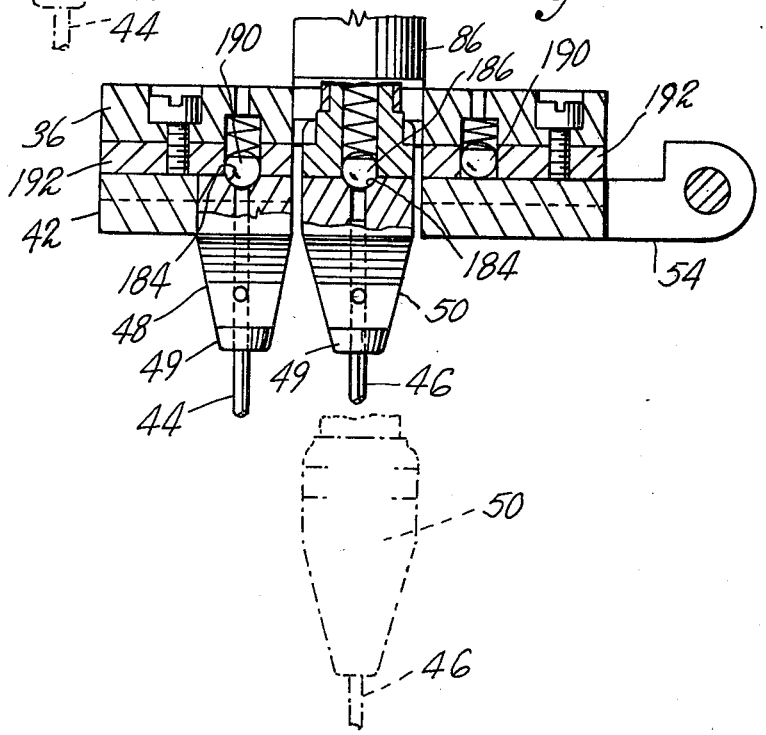
FIG. 9 is a view similar to FIG. 8 with the sewing machine in a subsequent operational mode.

The stitching mechanism 26 may be activated, once the desired needle 44 or 46 is moved or shuttled to the active position, and the remaining needle 44 or 46, is shuttled to the inactive position. The active position or stitching position is located directly beneath the needle bar 86. The first needle 44 has its respective inactive position immediately adjacent the active position, (to its left as shown in the Figures) and the second needle 46 has an inactive position 180° on the other side of the active position. That is, each needle 44 or 46, may be shuttled from its respective inactive position to the active position, while the other needle 44 or 46 is shuttled to its respective inactive position from the active position by actuation of the indexing cylinder 58, upon receipt of a proper signal, causing pivotal movement of the indexing lever 62 about its pivot point in the elbow 64 thereof. The extension 54 of the needle holder indexer 42, being attached to the indexing lever 62, pulls or pushes the needle holders 48 and 50 accordingly, with their respective needles 44 and 46, arranged therewith. The channels 90 on each needle holder 48 and 50 respectively, are pulled or pushed onto the flanges 88 of the needle bar 86 according to the direction of motion of the needle holder indexer 42, which is a function of whether the piston rod 60 of the indexing cylinder 58 is being extended or retracted. FIGS. 8 and 9 show the relationship of the first needle 44 and its needle holder 48 being in the active position. Each needle holder 48 and 50 has a channel therethrough and a detent 184 through which the needle 44 and 46 may pass. A ball 186 is biased by a spring 188 within the center of the needle bar the detent 184, to properly locate and help secure the needle holder 48 or 50 in the exact active position while stitching. Each inactive position has a biased ball 190 arranged between a locator plate 192 and the needle holder cage 36 to mate with the detent 184, to properly locate and help secure the needle holder 48 or 50 in its proper inactive position while the other needle holder 48 or 50 is in the active position, as shown between the FIGS. 8 and 9.

Referring again to FIG. 4, the thread pullback device 126 is shown including a pair of adjustable bolts or stops 194 attached to the upper portion of the bracket 132. They are utilized to regulate the amount of upward travel of the upper piston rods 134, which are contiguous with and hence regulate the amount of upward travel of the lower piston rods 136 and their guide rings 138 thereattached. The guide ring 138 on the lower piston rod 136 on whichever pressurizable cylinder 128 or 130 is holding the thread 160 or 170 for the active needle 44 or 46 is lower than the ring 138 holding up and out of the way the thread 160 or 170 for the needle in the inactive position. In the case shown in FIG. 4, the second needle 46 is in the inactive position and the needle holder cage 36 has been shuttled to the right, as viewed in the drawings, by proper actuation of indexing cylinder 58, by proper means, not shown. The thread 170 for the second needle 46 is caught between the tab extension 49 on the lower portion of the second needle holder 50 and the second resilient elastomeric wheel 74, thus keeping the inactive thread 170 taught and out of the way. The tail of the inactive thread 170 shown in FIG. 4 has been sucked into its respective vacuum tube 78, which vacuum is maintained in both tubes 78, by proper vacuum generating means, not shown. The lower piston rod 136 and its guide ring 138 of the first cylinder 128 is shown in phantom in its upper position and is shown in full lines where it would be in its lower position where it guides the thread 160 for the first needle 44 shown here as being in the active position.

FIG. 5, shows the lower piston rods 136 holding the threads 160 and 170 wherein the inactive needle in this view is the first needle 44 having the tail of its thread 160 sucked into the vacuum tube 78 and the thread 160 above the eye of the first needle 44 being trapped between the tab extension 49 on the lower portion of the first needle holder 48 and the first resilient elastomeric wheel 66, thus keeping the inactive thread 160 taught and out of the way.

The needle holders 48 and 50 are not permitted to be shuttled by activation of the indexing cylinder 58 until the active needle holder 48 or 50 is brought into alignment with the other inactive needle holder 48 or 50, whereupon the indexing cylinder 58 may be activated by the proper mechanism, not shown, to effectuate the shuttle. The proper alignment occurs when the wedge shaped extension 54 is caused to be inserted into the wedge shaped detent 146 on the disk 144 by actuation of its pneumatic cylinder. This brings the rotational movement of the drive shaft 28 to a stopped position within ±0.5° of the desired angular position. The drive shaft 28 in turn, effectuates the positioning of the needle bar 86, permitting, through proper circuitry, the pressurization of the indexing cylinder 68 to complete the needle shuttle, and thus, allows automatic stitching by the successive needle as required of the machine 20.

I claim:

1. A sewing machine having a plurality of reciprocably movable spaced apart shuttlable needles to permit the stitching of several different kinds of threads, said sewing machine comprising:

a shuttle means wherein a first needle and a second needle may be moved, one from an active sewing position transversely to an inactive standby position, the other from an inactive standby position transversely to the active position, said shuttle means including an indexer which moves said first and second needles simultaneously;

and an indexing cylinder, attached to said indexer through a linkage, which when actuated, effectuates the shuttle of said needles;

said needles being each supported by a needle holder, said needle holders being reciprocably supported in said indexer, said indexer being transversely supported in a needle holder cage, wherein a biased detent means is arranged between said needle holder cage and said needle holders to facilitate alignment and proper location of said needles in the inactive positions.

2. A sewing machine as recited in claim 1, wherein said needle holder, when in the active sewing position, is aligned with a reciprocable needle drive bar which effectuates the reciprocable motion in said active needle, said alignment being effectuated by a biased detent means arranged between said needle drive bar and said needle holder in said active securing position.

3. A sewing machine having a plurality of reciprocably movable shuttlable needles to permit the stitching of several different kinds of threads, said sewing machine including:

a means for shuttling said needles transversely from an active sewing position to an inactive standby position and simultaneously therewith, from an inactive standby position to the active sewing position;

a thread tail vacuum removal tube to draw away any thread extending from the eye of each needle in its respective inactive position, each of said tubes being arranged at the eye of each needle against the direction of feed motion of said thread through said eye.

4. A sewing machine having a plurality of reciprocably movable spaced apart shuttlable needles to permit the stitching of several different kinds of threads, said sewing machine comprising:

an arrangement of needle holders for supporting each of said needles;

an indexer for carrying said needle holders between their inactive positions and the active position;

a needle holder cage for supporting said indexer and said needles in their proper positions; and a thread nipping means for securing the thread of the inactive needle against being pulled from the eye thereof.

5. A sewing machine as recited in claim 4, wherein said thread nipping means comprises a resilient fixed axis wheel arranged adjacent each inactive standby position and a tab extending from each needle holder, wherein the thread is rolled between said wheel and said tab during shuttling of a needle and needle holder from the active position to one of the inactive standby positions.

6. A sewing machine as recited in claim 5, wherein said thread pinched between one of said wheels and its respective tab on a needle holder in the inactive standby position is freed therefrom when said needle holder and needle is shuttled to the active position from the inactive standby position.

7. A sewing machine having a plurality of reciprocably movable spaced apart shuttlable needles to permit the stitching of several different kinds of threads, said sewing machine comprising:

a thread tension regulation and monitoring means for regulating the tension of a plurality of threads simultaneously which threads are each fed to a reciprocably movable shuttlable needle, said thread tension regulation means comprising a thread engaging wheel journalled on an axis, for receiving thread therearound, one thread engaging wheel for each thread being utilized by said machine;

an adjustable knob arranged on said axis to provide a regulatable bias against the side of said thread engaging wheel; and a roller thrust bearing arranged on said axis between adjacent thread engaging wheels to distribute the bias therebetween and regulate the tension in the threads regardless of which thread engaging wheel is being rotated.

8. A sewing machine as recited in claim 7, wherein a friction disk is arranged between each thread engaging wheel and a non-rotative element on said axis, to vary the friction therebetween of the respective thread engaging wheels to permit variations in the tension of respective threads which may be required because of thickness or fiber differences thereof.

9. A sewing machine as recited in claim 7, wherein said thread monitoring means comprises a disk having a perforated periphery arranged adjacent each thread engaging wheel, each of said perforated disks extending radially beyond the perimeter of said thread engaging wheels and into an encoder device for monitoring the thread usage as said perforated disks and thread engaging wheels are turned on said axis.

10. A sewing machine having a plurality of reciprocably movable spaced apart shuttlable needles to permit the stitching of several different kinds of threads, said sewing machine comprising:

a thread pullback mechanism including a double acting pressurizable cylinder for each thread, said mechanism mounted on a bracket on said sewing machine, said pressurizable cylinder having a rod arranged at each end, one end being in contact with an adjustable stop mounted on said bracket, the other end having a ring through which a thread extends, the ring for the needle in an active position being held close to said active needle, the ring for the needle in an inactive standby position being withdrawn close to the cylinder, the one rod at the other end of the cylinder for the inactive needle pressing against its respective adjustable stop mechanism, to hold the inactive thread out of the way from any stray movement in the thread of the active needle.

11. A sewing machine having a plurality of reciprocably movable spaced apart shuttlable needles in a shuttle mechanism to permit the stitching of several different kinds of threads, said needles being reciprocably moved by their interengagement with a rotatable drive shaft;

said needles being shuttlable from an inactive standby position to an active position to effectuate stitching therewith;

an alignment mechanism arranged with said drive shaft to permit alignment of said needles prior to the shuttling of said needles from an inactive standby position to the active position, said alignment mechanism comprising;

a disk mounted on said drive shaft, said disk having a wedge shaped detent disposed therein;

a pressurizable cylinder having a piston rod which extends toward said drive shaft; and a wedge shaped extension disposed on the end of said piston rod, engagable with said wedge shaped detent on said disk on said drive shaft to effectuate proper cessation of rotational movement upon receipt of a proper signal by said cylinder effectuating alignment of said needles in said shuttle mechanism to permit said shuttlable movement of said needles from the inactive standby position to the active position and from the active position to one of the inactive positions.

12. A method of changing threads on a workpiece being stitched by a stitching machine, comprising:

actuating a pressurizable cylinder having an extension on a piston rod thereof;

directing said extension into a detent on a rotatable drive shaft to properly align the rotational characteristics of said drive shaft to permit alignment of a shuttlable needle arrangement thereassociated.

13. A method of changing threads on a workpiece being stitched by a stitching machine as recited in claim 12, including:

bringing a pair of needle holders in said needle arrangement into alignment with one another at the cessation of rotation of said drive shaft;

shuttling said needle holders to effectuate a transfer of a needle therewith from its active position to an inactive position, and to simultaneously effectuate the transfer of a needle in the other holder from its inactive position to the active position.

14. A method of securing threads from straying in a multiple needle stitching machine, comprising:

supporting an arrangement of needles in an arrangement of needle holders;

aligning said needle holders in a needle holding cage;

providing an arrangement of fixed axis wheels in close proximity to said needle holders;

shuttling said needle holders in said needle holding cage; and pinching one of said threads between one of said wheels and an extension of said machine as said needle holders are shuttled therepast.

15. A method of withdrawing an inactive thread from entanglement with an active thread in a multiple needle stitching machine, comprising:

providing an array of shuttlable threaded needles in a needle support shuttlable from an active position to inactive positions and from the inactive positions to the active position;

providing an actuatable piston and cylinder arrangement for each threaded needle in said needle support;

threading each of said threads through a respective guide loop on the rod of each piston; and retracting the thread of the needle in the inactive position by retracting the piston and rod, thus pulling away the guide loop and thread therewith from the vicinity of the thread of the active needle.

16. A method of regulating the tension in a plurality of threads simultaneously, in a multiple needle stitching machine, comprising:

providing an axis on a portion of said machine;

arranging a thread receiving wheel to be rotatably disposed on said axis, one thread engaging wheel for each needle utilized in said machine;

arranging an adjustable knob on said axis, to provide a bias against the side of said thread engaging wheels; and disposing a thrust bearing between adjacent thread engaging wheels.

17. A method of regulating the tension in a plurality of threads simultaneously, in a multiple needle stitching machine, as recited in claim 16, including:

providing a frictional disk between one of said disks and a non-rotative element on said axis, to effectuate different rotational characteristics in its respective thread receiving wheel as it is being rotated.

* * * * *